US006502515B2

(12) United States Patent
Burckhardt et al.

(10) Patent No.: US 6,502,515 B2
(45) Date of Patent: Jan. 7, 2003

(54) METHOD OF MAKING A HIGH-EXPLOSIVE PROJECTILE

(75) Inventors: Helmut Burckhardt, Lauf (DE); Walter Simon, Herzogenrath (DE); Thomas Heitmann, Unterlüss (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/735,615

(22) Filed: Dec. 14, 2000

(65) Prior Publication Data

US 2001/0004868 A1 Jun. 28, 2001

(30) Foreign Application Priority Data

Dec. 14, 1999 (DE) ..... 199 60 180

(51) Int. Cl.[7] ..... F42B 12/22; F42B 12/32

(52) U.S. Cl. ..... 102/493; 102/492; 102/494; 102/495; 102/506

(58) Field of Search ..... 102/493, 492, 102/495, 506, 494

(56) References Cited

U.S. PATENT DOCUMENTS

| | | | | | |
|---|---|---|---|---|---|
| 2,382,277 | A | * | 8/1945 | Whitesell, Jr. | 102/493 |
| 2,393,275 | A | * | 1/1946 | Whitesell, Jr. | 102/493 |
| 2,798,431 | A | * | 7/1957 | Semon et al. | 102/493 |
| 3,566,794 | A | * | 3/1971 | Pearson et al. | 102/493 |
| 3,599,573 | A | * | 8/1971 | Sliney | |
| 3,768,414 | A | * | 10/1973 | Polcha | 102/493 |
| 3,783,790 | A | * | 1/1974 | Polcha | 102/493 |
| 3,799,054 | A | * | 3/1974 | LaRocca | 102/493 |
| 3,956,989 | A | * | 5/1976 | Sallade et al. | 102/493 |
| 4,516,501 | A | * | 5/1985 | Held et al. | 102/493 |
| H238 | H | * | 3/1987 | Adams | 102/493 |
| 4,781,117 | A | * | 11/1988 | Garnett et al. | 102/493 |
| 5,095,821 | A | * | 3/1992 | Merz | 102/493 |

FOREIGN PATENT DOCUMENTS

| | | | | |
|---|---|---|---|---|
| DE | 1503143 | * | 3/1978 | 102/493 |
| DE | 2837638 A1 | * | 3/1979 | 102/493 |
| DE | 3401249 | * | 7/1985 | 102/493 |
| GB | 2013842 A | * | 8/1979 | 102/493 |

* cited by examiner

*Primary Examiner*—Michael J. Carone
*Assistant Examiner*—Lulit Semunegus
(74) *Attorney, Agent, or Firm*—Venable; Norman N. Kunitz

(57) ABSTRACT

A method of providing a high-explosive projectile with desired areas of fragmentation includes the following steps: securing a steel plate component in a circumferentially extending recess in the outer surface of a projectile body; directing an energy beam to outer surface portions of the steel plate component; heating, by the energy beam, narrow zones to a temperature above the melting temperature of the steel plate component to a predetermined depth thereof; and cooling the heated zones for effecting structural metallurgical changes in the steel plate component for obtaining the desired areas of fragmentation.

8 Claims, 1 Drawing Sheet

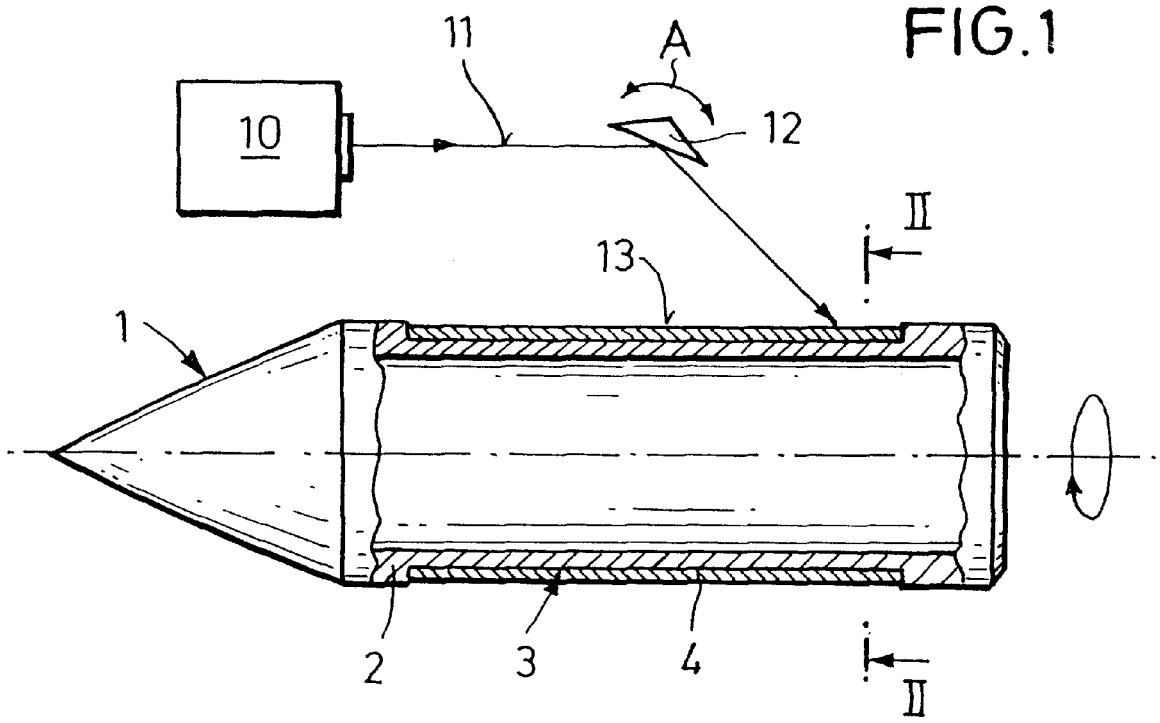
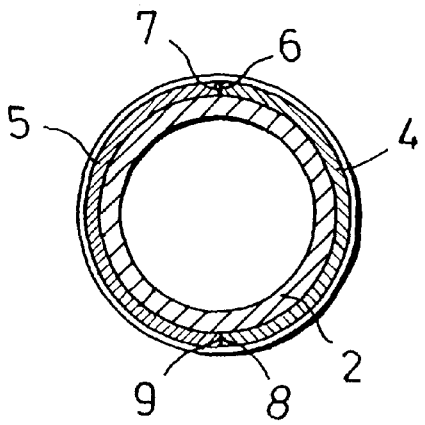
FIG.2
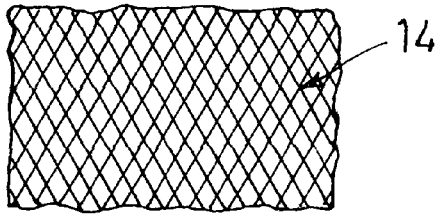
FIG.3

METHOD OF MAKING A HIGH-EXPLOSIVE PROJECTILE

CROSS REFERENCE TO RELATED APPLICATION

This application claims the priority of German Application No. 199 60 180.1 filed Dec. 14, 1999, which is incorporated herein by reference.

BACKGROUND OF THE INVENTION

This invention relates to a method of making a high-explosive projectile having a projectile body which, by means of a thermal post-treatment, is provided with desired fragmentation areas in a portion of its outer surface.

High-explosive projectiles of the above-outlined type are described, for example, in German Patent No. 21 26 351 to which corresponds British Patent No. 1,503,143 and German Offenlegungsschrift (application published without examination) No. 28 37 638, to which corresponds British Patent No. 2,013,842. For improving the fragmentation effect in these known high-explosive projectiles, the desired fragmentation areas are provided directly on the projectile body which, as a rule, is a one-part component. For this purpose, for example, small regions of the projectile body are melted by laser or electron beams and are subsequently cooled in such a manner that metallurgical structural changes (generally narrow martensite zones) are formed, along which the projectile subsequently breaks apart. The above-outlined conventional method is disadvantageous, because by virtue of the substantial heating and cooling of outer surface regions of the projectile body, underlying deeper regions of the projectile body may also be thermally affected, as a result of which a sufficient firing stability of the projectile body and thus the entire high-explosive projectile is frequently not ensured.

SUMMARY OF THE INVENTION

It is an object of the invention to provide an improved, simple method of providing a projectile body with desired fragmentation areas by heat treatment without adversely affecting the firing stability of the projectile.

This object and others to become apparent as the specification progresses, are accomplished by the invention, according to which, briefly stated, the method of providing a high-explosive projectile with desired areas of fragmentation includes the following steps: securing a steel plate component in a circumferentially extending recess on the outer surface of a projectile body; directing an energy beam to outer surface portions of the steel plate component; heating, by the energy beam, narrow zones to a temperature above the melting temperature of the steel plate component to a predetermined depth thereof; and cooling the heated zones for effecting structural metallurgical changes in the steel plate component for obtaining the desired areas of fragmentation.

The invention is based essentially on the principle to provide the desired fragmentation areas not directly on the projectile body as it has been done conventionally, but on a separate, shell-like steel plate component located in a suitable recess of the projectile body.

The invention ensures that in addition to securely avoiding a thermal effect on the projectile body, the region of the high-explosive projectile provided with desired fragmentation areas is, upon acceleration of the projectile in the weapon barrel, exposed to significantly lesser stress than the projectile body. This is so because the radial force introduction upon passage of the projectile through the weapon barrel occurs through the ductile projectile body and not through the brittle fragmentation plate or plates. The inner pressure generated by the acceleration of the explosive too, exerts its force solely to the ductile projectile body rather than to the fragmentation shell. The fragmentation plate therefore essentially needs only to support itself.

According to a preferred embodiment of the invention, two curved steel plate portions are inserted in a circumferential recess of the projectile body in such a manner that the steel plate portions circumferentially adjoin one another. Then the steel plate portions are first temporarily secured to the projectile body. The permanent securement of the two steel plate portions is thereafter effected by welding the steel plate portions together as areas of the latter are melted to render those areas brittle. In case the steel plate component is a one-piece tube rather than a longitudinally multi-part member, it has to be connected to the projectile body by suitable securing and/or supporting elements.

It has been found to be advantageous to guide the laser or electron beams required for the local melting of the steel plate component in such a manner that the structural changes extend helically or have a helical crisscross pattern. The generation of helically extending spiral structural changes performed on a projectile body is described, for example, in U.S. Pat. No. 3,783,790.

BRIEF DESCRIPTION OF THE DRAWINGS

FIG. 1 shows schematically a sectionally illustrated high-explosive projectile during a zonewise welding of steel plate component parts positioned in a receiving recess provided circumferentially in the projectile body to produce defined structural changes.

FIG. 2 is a sectional view taken along line II—II of FIG. 1.

FIG. 3 is a fragmentary top plan view of a projectile region having structural changes provided with a method according to the invention.

DESCRIPTION OF THE PREFERRED EMBODIMENTS

FIG. 1 shows a high-explosive projectile 1 having a projectile body 2, depicted prior to the insertion of the explosive charge. The projectile body 2 has, on its outer surface, an annularly surrounding depression or recess 3 in which two curved steel plate parts 4 and 5 are accommodated and temporarily secured. As shown in FIG. 2, the steel plate parts 4, 5 are in mutual contact along their axially extending edges 6, 7 and, respectively 8, 9.

A laser beam generating device 10 generates a powerful laser beam 11 which is directed by a pivotal mirror 12 to the upper surface 13 of the steel plate parts 4, 5 which are thus heated zonewise to a temperature which is above the melting temperature of steel. The melting depth of the steel plate parts 4, 5 should not exceed 75% of the wall thickness of the steel plate parts to securely avoid a temperature effect on the material of the projectile body 2.

Since the projectile 1 is rotated in a holding device (not illustrated for the sake of clarity) as the mirror 12 executes an oscillating motion as indicated by the arrow A, the heat-treated, narrow, line-like area of the parts 4, 5 has a spiral course. Such area is first melted and, due to the rapid, subsequent cooling, undergoes a structural change characterized by embrittlement. An additional similar heat treatment with a changed guidance of the laser beam results in a crisscross spiral structural modification so that diamond-shaped surfaces with brittle zones (desired fragmentation locations) 14 are obtained as shown in FIG. 4.

To obtain regions with a high degree of embrittlement, the material of the steel plate parts 4, 5 has preferably a high carbon content to obtain a possibly large number of martensite structures in the weld zone.

During the welding process, the steel plate parts 4, 5 are connected to one another along their axially extending edges 6, 7 and, respectively, 8, 9, for example, by means of overlapping, subsequently applied longitudinal seams. The temporary securement of the steel plate parts 4, 5 to the projectile body 2 may subsequently be removed.

It is to be understood that the invention is not limited to the above-described embodiment. Rather, the structural changes, dependent upon the guidance of the laser beam, may have rectangular, quadratic, hexagonal or circular shape rather than the described diamond shape.

Further, instead of a laser beam, an electron beam may be utilized as a heat source for the zonewise melting of the steel plate parts. In such a case the heat-treating method is preferably performed in vacuum so that a sufficiently coherent electron beam is obtained for producing narrow melting zones.

It will be understood that the above description of the present invention is susceptible to various modifications, changes and adaptations, and the same are intended to be comprehended within the meaning and range of equivalents of the appended claims.

What is claimed is:

1. A method of providing a high-explosive projectile with desired areas of fragmentation, comprising the following steps:

(a) securing a steel plate component in a circumferentially extending recess in an outer surface of a projectile body;

(b) directing an energy beam to outer surface portions of said steel plate component;

(c) heating, by the energy beam, narrow zones of said steel plate component to a temperature above the melting temperature of the steel plate component to a predetermined depth thereof; and (d) cooling the heated zones for effecting structural metallurgical changes in the steel plate component for obtaining said desired areas of fragmentation.

2. The method as defined in claim 1, wherein step (a) comprises the step of securing two longitudinal half-tube steel plate parts, constituting said steel plate component, in said recess of the projectile body such that respective longitudinal edges of said longitudinal half-tube steel plate parts adjoin one another.

3. The method as defined in claim 2, wherein step (c) comprises the step of heating the adjoining longitudinal edges of said longitudinal half-tube steel plate parts such that said edges melt and overlap, whereby during step (c) the adjoining edges are welded to one another.

4. The method as defined in claim 1, wherein steps (b) and (c) are performed by a laser beam.

5. The method as defined in claim 1, wherein steps (b) and (c) are performed by an electron beam.

6. The method as defined in claim 1, wherein step (b) comprises the step of directing the energy beam to said steel plate component in a helical path.

7. The method as defined in claim 1, wherein step (b) comprises the step of directing the energy beam to said steel plate component in a plurality of crisscrossing helical paths.

8. The method as defined in claim 1, wherein said predetermined depth is at the most 75% of a wall thickness of said steel plate component.

* * * * *